US005138945A

United States Patent [19]

Lee et al.

[11] Patent Number: 5,138,945

[45] Date of Patent: Aug. 18, 1992

[54] SYSTEM FOR REMOVING FOREIGN MATTER FROM A PLATE CYLINDER OF A PRINTING PRESS

[75] Inventors: Sung C. Lee, Bridgeport; James N. Crum, Stonington, both of Conn.

[73] Assignee: Man Roland Druckmaschinen AG, Offenbach-am-Main, Fed. Rep. of Germany

[21] Appl. No.: 744,276

[22] Filed: Aug. 13, 1991

[51] Int. Cl.[5] ..... B41F 35/00

[52] U.S. Cl. ..... 101/425; 101/423

[58] Field of Search ..... 101/157, 169, 350, 365, 101/423, 425, 424

[56] References Cited

U.S. PATENT DOCUMENTS

| | | | |
|---|---|---|---|
| 1,306,646 | 6/1919 | Trier | 101/424 |
| 3,252,416 | 5/1966 | Allen | 101/425 |
| 4,082,038 | 4/1978 | Ueno et al. | 101/425 |
| 4,499,827 | 2/1985 | Takeuchi et al. | 101/425 |
| 4,922,820 | 5/1990 | Grossman | 101/425 |
| 5,020,433 | 6/1991 | Jeschke et al. | 101/425 |

*Primary Examiner*—Edgar S. Burr
*Assistant Examiner*—Ren Yan
*Attorney, Agent, or Firm*—Frishauf, Holtz, Goodman & Woodward

[57] ABSTRACT

To rapidly and reliably remove foreign objects from rotating plate cylinders (10, 10'; 10*a*, 10*a*') of a printing machine, a carriage (12) is mounted on a keyboard (21) having keys associated with predetermined axial positions or zones on the plate cylinder, controls via a control unit (CU) rotation of the stepping motor to the respective axial zone which is selected by operation of one of the keys (20) of the keyboard. A solenoid then projects the wiper blade to remove a foreign object or hickey from the plate. In a multi-cylinder machine, the removal apparatus including the spindle, carriage, wiper blade and solenoid, is placed in association with each one of the cylinders, one keyboard and one control unit operating all the wiper blades in unison, thereby eliminating the need to determine on which one of the plate cylinders of, for example, a multi-color press, a foreign object has lodged. After removal of a foreign object, or a number of foreign objects, as counted by keyboard operation, the carriage is returned to a rest or cleaning position where a motor-operated brush, upon sensing the presence of the carriage, removes the objects from the blade.

13 Claims, 3 Drawing Sheets

1
2
3
4
5
6
7
8
9
10
11
12
13
14
15
16
33
34
35
36
20
35
30
SOLENOID
16
34
PA0
PA1
PA2
PA3
PA4
PA5
PA6
PA7
PB0
PB1
PB2
PB3
PB4
PB5
PB6
PB7
MC68705P3 MICROCOMPUTER
PC0
PC1
PC2
PC3
INT
CLOCK
TIMER
4
5
60Hz SIGNAL
CD4040
÷6156
Q12
Q11
Q3
Q2
35
RESET
32
36
CD4040
÷500
Q8
Q7
Q6
Q2 Q4 Q5
33
TRANSLATOR
CW/CW
31
4MHZ OSCILLATOR
RESET
13

SYSTEM FOR REMOVING FOREIGN MATTER FROM A PLATE CYLINDER OF A PRINTING PRESS

FIELD OF THE INVENTION

The present invention relates to a system to remove foreign matter from the plate cylinder of a printing machine, and more particularly to a system to appropriately place a wiper blade at selected axial positions against the plate cylinder to remove foreign matters therefrom, which are known in the printing field as "hickeys", and more particularly to an apparatus of the type referred to in the printing field as a "hickey picker".

Foreign particles, generally known as "hickeys" must be removed from the image area of a plate cylinder. If not removed, the image transferred to the blanket cylinder and, sequentially, to the printed substrate or signature will contain defects, which will repeat on every printed page. These defects may take the form of, for example, an unprinted area, conforming to the outline of the foreign matter, and irregular shapes surrounded by halo, or a "weak" area.

It is undesirable to maintain a wiper blade in continuous contact with the plate cylinder due to wear on the blade and the plate cylinder, and possible smearing. See, for example, German Patent Disclosure Document 27 15 445, Ueno et al, and U.S. Pat. No. 3,252,416, Allen. In accordance with the Allen patent 3,252,416, a strip, or the like, is traversed across the cylinder of a printing machine by a spiral spindle, and move in and out of engagement by a cam mechanism, which tilts the rubber fabric element into and out of engagement with the printing cylinder. Over the course of several revolutions of the cylinder, the fabric wiper strip will have contacted all regions of the cylinder. Any foreign matter which is deposited on the wiper strip is then placed within the water area of the cylinder, that is at the edge, from where it will be picked up by the tacky ink rollers and removed from the plate segment and, eventually, deposited in the ink fountain.

THE INVENTION

It is an object to provide a foreign object removal system which is rapidly operating, easily controlled to pick up foreign objects observed on signatures, either visually or automatically, and which provides for prompt removal of picked-up objects from a pick-up wiper.

Briefly, the system to remove foreign objects from a cylinder, typically the plate cylinder of a printing machine, is effective during operation of the printing machine, and includes a keyboard to generate an object removal signal, which is representative of the actual axial position of the object on the cylinder, as determined, for example, by visual inspection. A screw spindle is rotated by a motor, preferably a stepping motor, which is coupled to receive the removal signal and, since the removal signal is representative of the axial position of the object, controls the motor to rotate the spindle so that a carriage on the spindle will move to the respective axial position. The carriage supports a wiper blade which can be projected towards and retracted from the cylinder, for example a solenoid which, upon energization, pushes the wiper blade in wiping engagement with the cylinder and, upon de-energization, permits retraction, for example under spring pressure.

The solenoid can be energized by, for example, a slider terminal riding on a rail which, at the same time, prevents rotation of the carriage as the spindle rotates.

In accordance with a preferred feature of the invention, the signal generating means comprises a keyboard having keys which are operator identifiable, for example carrying numbers representative of the measurement of the axial extent of the cylinder to be cleaned, and identifying discrete zones along the axial extent of the cylinder. A suitable motor control circuit then can generate the number of stepping pulses for the stepping motor required to rotate the spindle over the necessary distance from either a predetermined start or rest position to an object to be picked up or from the position where, previously, an object has been picked up, to another location. The determination of whether the spindle is to turn clockwise (CW) or counterclockwise (CCW) to move the carriage either to the left or right, for example, can readily be determined by well known logic circuitry.

The system, preferably, further includes a brush located at one of the terminal travel positions of the carriage, which may be the start or rest position and, then, also defines a cleaning position. Preferably, the brush is a power operated brush, such as a small rotary brush, energized whenever the carriage is at the cleaning position, to remove objects picked up by the carriage from the wiper blade. The operating time of the brush can be set either by a time or, for example, by sensing current flow through the brush motor and, when the brush motor current drops, indicating that the usually rather sticky object has been removed from the wiper blade, and permitting the motor to run more freely, will shut off the brush motor.

In accordance with a feature of the invention, and in a simple embodiment, the signal generating means is a keyboard which controls operation of the carriage to one predetermined position and, after the wiper blade has been projected towards the cylinder for either a predetermined period of time or after the cylinder has rotated about a predetermined angle, for example a full revolution, causes retraction of the wiper blade and return of the carriage to the rest or cleaning position. In accordance with another embodiment, the number of removal signals are counted and when a predetermined number of objects have been removed, for example upon counting five consecutive removal signals, the carriage is then returned to the rest or cleaning position.

Two such systems are provided for printing machines printing on two sides of a web, that is, for perfecting printing, one for each one of the systems printing on a respective side of the web. In multi-color, multi-cylinder presses, in which a first group of cylinders prints on one side of the substrate and another group of cylinders prints on the verso side, a keyboard is preferably provided for each side of the web, however a single keyboard may be provided with means to switch its control from one side to the other coupled to a group of removal apparatus systems, each including a spindle, carriage, wiper blade and motor, and all controlled from the same keyboard. It is frequently difficult to determine, in multi-cylinder presses, exactly on which plate cylinder an object may be lodged. Thus, the arrangement permits control by a single keyboard determining the axial position of a defect or "hickey" on the printed web, to clean all the cylinders at the specific location of the hickey, thus eliminating individual inspection of cylinders and of rapidly running webs between the respective stations of a multi-cylinder or multi-station printing machine.

The control of the system can be instrumented, in accordance with a feature of the invention, by a combination of keyboard entry—microprocessor control. For purposes of illustration, a keyboard may have 36 keys, numerically identified and associated with predetermined axial zones across the printing machine; other types of keyboards, for example keyboards having a decimal system, with suitable conversion control circuit, can be used.

The arrangement has the advantage that it readily permits retrofiting existing printing presses with a hickey removal arrangement which is compact, versatile, and easily adapted to multi-printing station presses for multi-color printing.

DRAWINGS

DETAILED DESCRIPTION

Figure 4:
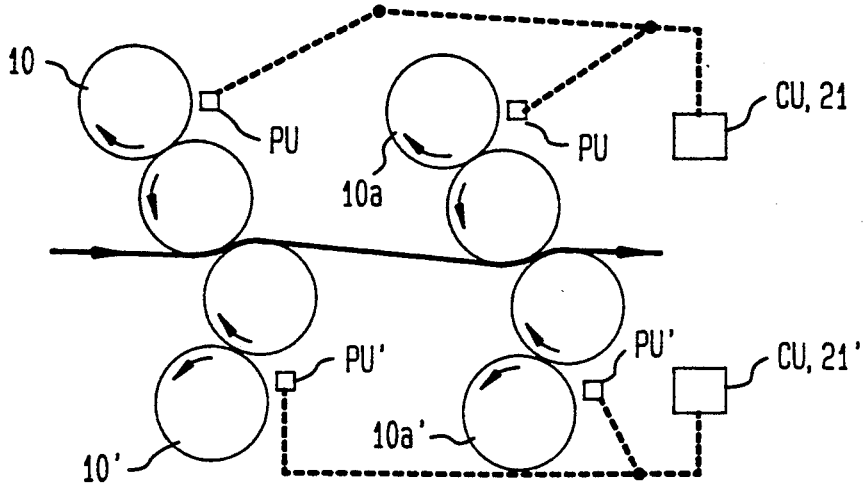
FIG. 4 is a highly schematic diagram of a multiple printing station printing press with the object removal system installed at respective printing stations.

The printing machine has a plate cylinder 10 or, if it is a multi-station printing unit (see FIG. 4), may have printing cylinders 10, 10*a*, 10′, 10*a*′; further printing cylinders may be used, for example to print all colors, which would require four cylinders, namely printing in yellow, magenta, cyan and black. FIG. 4 only shows two such stations, for prime and verso printing, respectively, for simplicity of illustrations. Inkers and dampers in the illustrated offset lithographic system have been omitted for simplicity. The system to remove foreign objects such as hickeys should be located in advance of the ink application roll or cylinder in engagement with the plate cylinder 10, that is, in advance of the inker—with respect to the direction of rotation of the plate cylinder.

Figure 1:
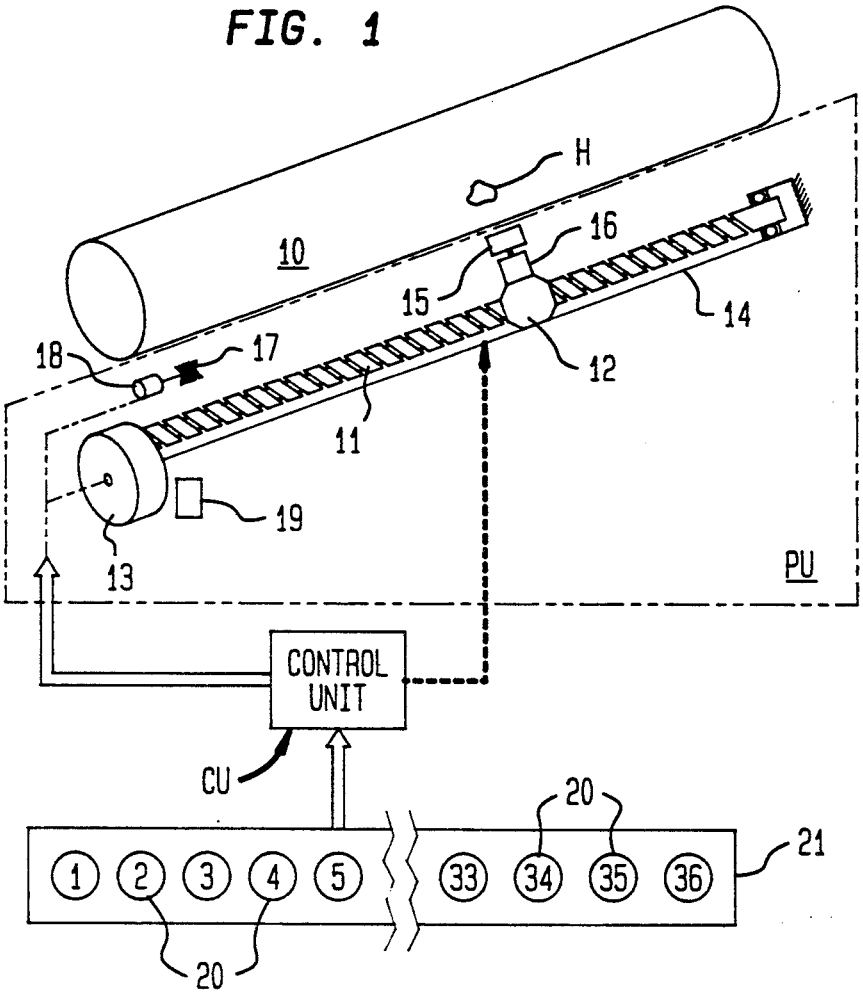
FIG. 1 is a highly schematic, part-pictorial diagram of the object removal system, and its control, in accordance with the present invention.

Referring specifically to FIG. 1:

Plate cylinder 10 is shown as having a foreign object, such as a hickey H, located thereon. A rotatable threaded coarse screw spindle 11 extends parallel to the plate cylinder 10. A carriage 12 is fitted on the spindle, having a thread matching the thread of the spindle 11. Spindle 11 is rotated by a motor 13, preferably and in accordance with a feature of the invention, a stepping motor, so that the rotation thereof can be accurately controlled. The carriage 12 is restrained from rotating with the spindle. This can be done, for example, by placing a slider rod, rail or the like, shown at 14 in FIG. 1, parallel to the spindle 11.

The carriage 12 carries a wiper blade 15, for example about 4 cm wide, and made of an elastomer, such as rubber, e.g. a piece of automotive windshield wiper, plastic or the like, which normally is out of engagement with the plate cylinder. The carriage 12 carries a solenoid 16, which can project the wiper blade 15 towards the plate cylinder to remove the object H therefrom, as the cylinder rotates. If a guide rod or rail 14 is used, the guide rod or rail 14 can be located insulated with respect to the spindle 11, and form a current carrying element for the solenoid energization current. Alternatively, a flexible cable can be coupled to the carriage 12.

The carriage 12, in accordance with a feature of the invention, is placed in position to remove the object H at a specific axial location on the plate cylinder by pressing a suitable button 20 on a control panel 21. The control panel 21 is connected to a control unit CU, to be described below, which causes energization of the stepping motor 13 to move the carriage 12 from either a fixed end or rest position to the axial zone where the object H is located, or to move from a previously stationary position at a prior zone, where a previous hickey has been removed to the particular axial location of the hickey H.

After the hickey H has been removed, by engagement of the blade 15 and wiping against the plate cylinder 10, the solenoid is de-energized. The motor 13, in one mode of operation, is then energized to rotate the spindle to return the carriage 12 to the end or rest position which, in the illustration of FIG. 1, will be at the left side adjacent the motor 13. In another mode of operation, the carriage remains stationary, until operation of a key 20 on keyboard 21 commands removal of another object at a different location, and controls motor 13 to move the carriage. Repeat operation of the same key will merely cause repeated wiping action under control of solenoid 16.

At the end or rest position, a rotary brush 17, rotated by a wiper or brush motor 18, brushes against the wiper blade 15, to remove the previously picked up object or objects H from the wiper blade. Preferably, this position is beyond the axial end of the plate cylinder.

The control panel 21 can be integrated with or form part of a control desk, forming the overall control console or control panel for the printing machine system, as illustrated, in part, schematically in FIG. 4. The position, along the axis of the plate cylinder 10, of the object H can be determined, preferably visually, by the printing machine operator.

The control unit CU includes a counter, a clock unit, and suitable circuitry to convert control output signals, as derived from the control panel 21 to current pulses of sufficient energy to rotate the motor 13, and hence the spindle 11 to move the carriage 12 to the assigned axial zonal position, and to then operate the hickey picker, i.e. solenoid 16—wiper blade 15 by operating the solenoid 16 on the carriage 12, and then to move the carriage to a new position or, alternatively, to the rest or cleaning position for subsequent cleaning of the wiper blade.

Figure 2:
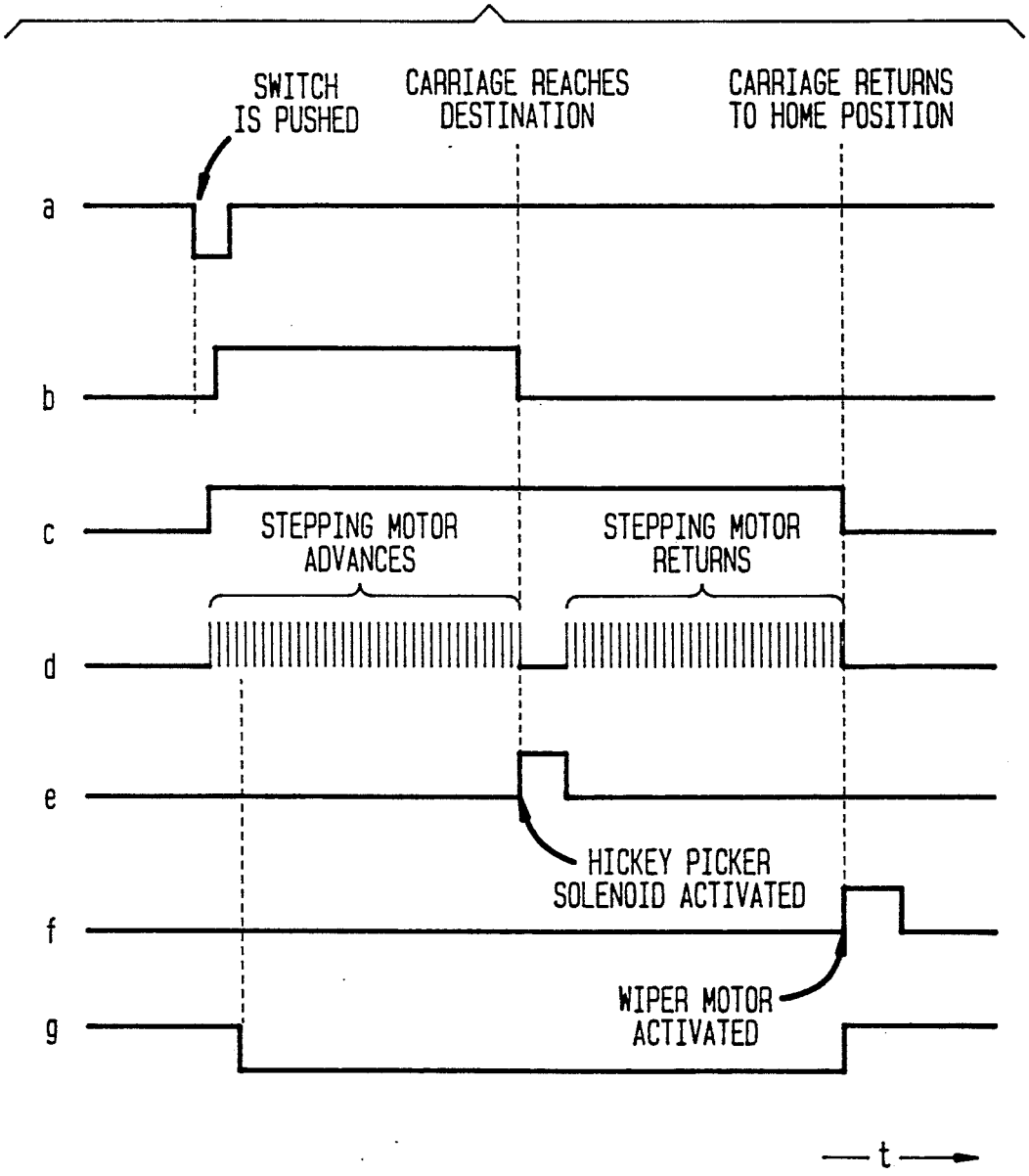
FIG. 2 is a timing diagram illustrating one mode of operation of the system.

FIG. 2 illustrates, schematically, a timing diagram, in which graph a illustrates the situation in which any one of the away from the plate cylinder, for example under spring pressure.

In accordance with a feature of the invention, the stepping motor 13 is then energized to rotate in the opposite direction to return the carriage 12 to the rest or cleaning position. When this position has been reached, which is determined by the count of the stepping motor pulses as well as by sensing the position by the Hall effect sensor, see graph g, the stepping motor is de-energized and the wiper motor 18 is activated to rotate the brush 17, in engagement with the wiper blade 15 at the rest or cleaning position, and to clean the foreign object H off the wiper blade 15.

In accordance with a modification of the invention, when the solenoid is de-activated, graph e of FIG. 2, the carriage 12 will remain at the position at which it was then located. The control unit CU contains a memory to memorize the particular axial position. If, then, the operator notices another hickey at a different position, pressing a button for the different position will cause a sufficient number of pulses to be applied to the stepping motor corresponding to the distance between the previous position and the new position and, when the new position has been reached, the solenoid will again be activated.

Since, each time the solenoid 16 is activated, and the wiper blade 15 picks up an object, a number of objects will accumulate on the wiper blade. Thus, after predetermined number of objects have been picked up, for example three to five, operating a further removal button will not cause movement of the carriage to the new axial position but, rather, first return to the rest and cleaning position for cleaning off the accumulated objects, and then, automatically, to the position commanded in advance of the return of the carriage to the commanded cleaning position. Including only a small amount switches is pushed, generating a starting pulse. A sensor 19, adjacent the cleaning or rest position of the carriage 12, for example a Hall effect sensor, switches state as soon as the carriage 12 leaves its range, see FIG. 2, graph g. Graph b illustrates an energization curve for a control lamp, not shown, indicating on the panel 21 that the carriage 12 is moving. Graph c indicates the energization stage of another control lamp, not shown, on the control panel 21 which indicates that the carriage 12 is not at the rest or cleaning position.

The control unit CU, as soon as a switch has been pushed, generates suitable stepping motor advance pulses, see graph d, which will continue to rotate the motor until the motor has reached the axial position determined by the particular position button 20 of the control panel 21 which has been operated. When this position has been reached, which is determined solely by the distance through which the motor has rotated, and is independent of the operating speed of the motor, as well known in stepping motor operation, the spindle will stop rotating and, in a sequence controlled by the control unit CU, the solenoid 16 will be energized to project the wiper blade 15 against the rotating plate cylinder.

It will stay engaged against the plate cylinder for a predetermined angular rotation of the plate cylinder, which can be converted, if plate cylinder speed is supplied to the control unit in the form of a speed signal, into a time period for energization of the solenoid 16. The operation of the hickey picker solenoid is shown in graph e of FIG. 2.

After the plate cylinder has rotated over a predetermined angle of rotation, for example 360°, or such angle as may be covered by a printing plate, the solenoid can be de-energized, which will cause retraction of the wiper blade of memory within the control unit CU readily permits the control unit to store position settings.

The control panel 21 can carry sufficient numbers to be representative of the entire width of the plate cylinder 10; alternatively, it can be arranged in decimal fashion, requiring multiple operation of buttons, and extending the range or resolution of movement of the carriage to 99 zones or positions.

Figure 3:
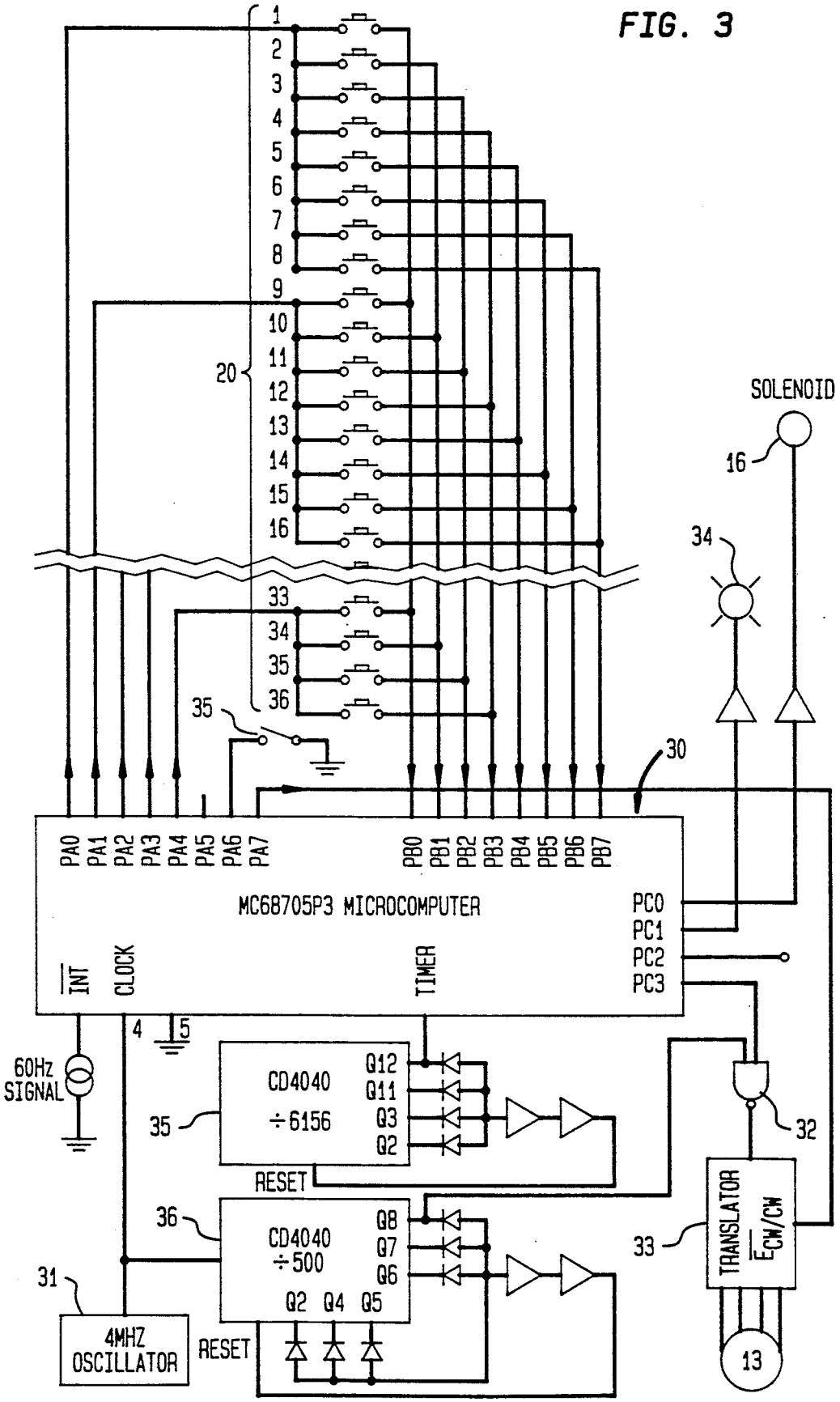
FIG. 3 is an illustrative diagram illustrating one way of constructing the electronic portion of the system.

FIG. 3 illustrates, highly schematically, a suitable connection arrangement for the system of FIG. 1. The control panel 21 is shown as a plurality of switches, connected in binary connection to a microcomputer MC68705P3, in which the respective ports are shown in FIG. 3. The microcomputer is energized by a standard 60 Hz power line signal at input port INT, and contains its own clock. It can also be connected, as shown, to an external 4 MHz oscillator 31.

The microcomputer 30 is connected to stepping motor 13 through a gate 32 and a signal-to-power translator 33. The microcomputer 30 also provides an output signal to indicator lamp 34, not shown on the control panel 21, and to control the solenoid 16 on the carriage 12. Suitable dividers 35, 36 divide the clock frequency derived from oscillator 31, as shown in FIG. 3.

In accordance with a feature of the invention, see FIG. 4, the arrangement of the spindle 11, carriage 12, motor 13, and all the elements used to energize and operate the wiper blade 15, shown generally as pick-up unit PU within the chain-dotted line of FIG. 1 are coupled to a single keyboard 21 for each one of the printing sides, prime and verso, respectively. Thus, the units PU, in the multi-station printing system of FIG. 4, can all be controlled from a common control unit CU and from a single keyboard. A further keyboard 21' and a further control unit CU' is provided for the pick-up units PU' which, preferably, are functionally and mechanically identical to the pick-up unit PU, but associated with the verso printing systems of the respective printing stations.

FIG. 3 is highly schematic and illustrates the major portions of the control unit CU; circuit details, such as pull-up resistors and the like, have been omitted for clarity. Port PA6 of the microcomputer 30 is connected to a switch which senses when all the carriages 12 are at their home or rest or cleaning position, for example as indicated by all the sensors 19 providing the appropriate high level output signal as shown in graph g of FIG. 2. This is a safety feature in case of malfunction of any one of the movable elements within the pick-up unit PU.

Various changes and modifications may be made within the scope of the inventive concept.

We claim:

1. A system to remove foreign objects (H) from a cylinder (10) of a printing machine during operation of the printing machine comprising keyboard means (20, 21) for generating a plurality of removal commands, each representative of one axial position of one object (H) on the cylinder (10); and removal apparatus (PU) including a spindle screw (11);

a stepping motor (13) coupled to the spindle screw for rotating the spindle;

a carriage (12) mounted on the spindle screw;

a wiper blade (15) selectively engageable with the cylinder (10) and disengageabe therefrom;

electrical blade moving or operating means (16) secured to the carriage and selectively projecting said wiper blade toward the cylinder (10) for engagement with and stripping off a respective object (H) therefrom, and retracting the wiper blade;

object removal means (17) located at a carriage, rest or cleaning position which is located at an end of the spindle screw, said removal means including brush means arranged for engagement with said wiper blade (15) to remove objects (H) from the wiper blade which had been stripped off from the cylinder; and electrical control means (CU) coupling said removal signal to both said stepping motor (13) and said blade moving means (16);

said control means (a) providing stepping pulses to said stepping motor to move the carriage to the axial position of one of the objects (H), (b) controlling said blade moving means to project said wiper blade (15) toward the cylinder to strip said one object (H) from the cylinder at the respective cylinder position, (c) further controlling the blade moving means to retract the wiper blade (15) after the cylinder (10) has rotated about the predetermined angle of rotation; and (d) further controlling said stepping motor (13) to move the carriage (12) to the rest or cleaning position.

2. The system of claim 1, wherein said brush means (17) is located at said rest or cleaning position, arranged for engagement with said wiper blade (15) to remove objects (H) from the wiper blade which had been stripped off from the cylinder (10).

3. The system of claim 2, further including brush motor means 918) moving said brush means in engagement with the wiper blade (15) for forcibly brushing objects (H) off the wiper blade.

4. The system of claim 1, including counting means (19) counting the number of removal commands and controlling return of said carriage to the rest or cleaning position after a predetermined number of removal commands have been counted.

5. The system of claim 1, in combination with a multi-cylinder printing machine, in which at least two cylinders (10, 10') print on one side of a substrate web, wherein a single removal command generating means (20, 21) and control means (CU) is provided; and individual removal apparatus units (PU) are provided, associated with each of the at least two cylinders, and controlled by said single removal command generating means and said single control means.

6. The system of claim 1, including means (14) engaged by said carriage to prevent rotation thereof upon rotation of the spindle screw (11) by the motor means (13) while permitting axial movement of the carriage.

7. The system of claim 6, wherein said rotation prevention means (14) comprises an elongated rod or rail;

and wherein said rod or rail and said spindle screw (11) are electrically insulated with respect to each other, and provide, respectively, electrical terminals to provide electrical operating energy for said blade moving means (16).

8. The system of claim 1, further including current supply means to supply operating current to said blade moving means (16).

9. The system of claim 1, wherein said blade moving means comprises a solenoid.

10. A system to remove foreign objects (H) from a cylinder (10) of a printing machine during operation of the printing machine comprising:

keyboard means (20, 21) for generating a plurality of removal commands, each representative of one axial position of one object (H) on the cylinder (10); and removal apparatus (PU) including a spindle screw (11);

a stepping motor (13) coupled to the spindle screw for rotating the spindle;

a carriage (12) mounted on the spindle screw;

a wiper blade (15) selectively engageable with the cylinder (10) and disengageabe therefrom;

electrical blade moving or operating means (16) secured to the carriage and selectively projecting said wiper blade toward the cylinder (10) for engagement with and stripping off a respective object (H) therefrom, and retracting the wiper blade;

digitally operating electrical control means (CU) including a memory, and being coupled to said keyboard means (20, 21) for entering and retaining a plurality of removal commands, and the respective axial positions of objects to be removed, said electrical control means being coupled to both said stepping motor (13) and said blade moving means (16) and providing stepping pulses to said stepping motor to move the carriage to the axial position of one of the objects, as determined by the axial position of one of the objects, as determined by the axial position retained in the memory of the control means (CU), said control means then controlling the blade moving means to project said wiper blade (15) towards the cylinder to strip the object at said position from the cylinder and, after the cylinder has rotated about a predetermined angle of rotation, controlling the blade moving means to retract the wiper blade, said control means then providing further stepping pulses to the stepping motor to move the carriage to the axial position of another one of the objects, as determined by the axial position retained in the memory of the control means, and then controlling the blade moving means to project the wiper blade and, after the cylinder has rotated about a predetermined angle of rotation, to retract the wiper blade (15), said control means counting the number of removal commands and, selectively, either when (a) all removal commands within the memory have been executed; or (b) a predetermined number of executed removal commands have been counted, whichever is lower, said control means then controlling said motor (13) to move the carriage (12) to a rest or cleaning position, said rest or cleaning position being located at an extreme end of said spindle screw (11);

said system further including object removal means (17) at said rest or cleaning position to remove objects (H) from the wiper blade.

11. The system of claim 10, wherein said object removal means comprises brush means (17) located at said rest or cleaning position, arranged for engagement with said wiper blade (15) to remove objects (H) from the wiper blade which had been stripped off from the cylinder (10).

12. The system of claim 11, further including brush motor means (18) moving said brush in engagement with the wiper blade (15) for forcibly brushing objects (H) off the wiper blade.

13. The system of claim 10, in combination with a multi-cylinder printing machine, in which at least two cylinders (10, 10') print on one side of a substrate web, wherein a single removal command generating means (20, 21) and control means (CU) is provided; and individual removal apparatus units (PU) are provided, associated with each of the at least two cylinders, and controlled by said single removal command generating means and said single control means.

* * * * *